US010542789B2

(12) United States Patent
Siniscalchi

(10) Patent No.: US 10,542,789 B2
(45) Date of Patent: Jan. 28, 2020

(54) METHOD FOR MAKING A WADDING STRIP ELEMENT COMPRISING AT LEAST A SURFACE ADAPTED TO RECEIVE PRINT, AND THE WADDING STRIP ELEMENT MADE THEREBY, FOR US IN PADDINGS OF CLOTHING ARTICLES SUCH AS WINDCHEATERS AND SHOES

(71) Applicant: Fisi Fibre Sintetiche S.p.A., Oggiono (LC) (IT)

(72) Inventor: Lucio Siniscalchi, Oggiono (IT)

(73) Assignee: FISI FIBRE SINTETICHE S.P.A., Oggiono (LC) (IT)

( * ) Notice: Subject to any disclaimer, the term of this patent is extended or adjusted under 35 U.S.C. 154(b) by 0 days.

(21) Appl. No.: 15/670,798

(22) Filed: Aug. 7, 2017

(65) Prior Publication Data

US 2018/0035749 A1 Feb. 8, 2018

(30) Foreign Application Priority Data

Aug. 5, 2016 (IT) ..... 102016000082894

(51) Int. Cl.

| | |
|---|---|
| ***A43B 13/04*** | (2006.01) |
| ***A43B 17/00*** | (2006.01) |
| ***B41J 2/32*** | (2006.01) |
| ***B41J 2/335*** | (2006.01) |

(52) U.S. Cl.

CPC ..... *A43B 13/04* (2013.01); *A43B 17/003* (2013.01); *B41J 2/32* (2013.01); *B41J 2/3359* (2013.01)

(58) Field of Classification Search

USPC ..... 156/233, 241, 230, 234; 427/209, 211

See application file for complete search history.

(56) References Cited

U.S. PATENT DOCUMENTS 4,849,044 A * 7/1989 Siniscalchi ..... D06N 3/0063 156/233
5,271,997 A 12/1993 Baigas, Jr.
2003/0232552 A1 12/2003 So

FOREIGN PATENT DOCUMENTS

EP 0161380 A2 11/1985
EP 0161380 A3 11/1985
EP 0214939 A2 3/1987

(Continued)

OTHER PUBLICATIONS

Italian Patent Office Search Report and Written Opinion dated May 11, 2017 (partially in English).

*Primary Examiner* — Lynda Salvatore

(74) *Attorney, Agent, or Firm* — Hedman & Costigan, P.C.; James V. Costigan; Kathleen A. Costigan

(57) ABSTRACT

A method for making a wadding strip element, in particular to be used for making paddings of clothing articles such windcheaters and/or shoes, the wadding material being adapted for depositing thereon at least an auxiliary material, comprises at least the further step of subjecting the wadding strip element to a combined chemical, mechanical and thermal treatment process adapted to increase the mechanical strength of the wadding strip element and reduce its porosity, thereby allowing the deposit on at least a surface of at least a printing material or an auxiliary material thereby the deposited material only slightly penetrates the wadding material to create on the surface a predetermined printed pattern configuration adapted to withstand washing operations and inevitable wear, without decomposing.

9 Claims, 4 Drawing Sheets

(56) References Cited

FOREIGN PATENT DOCUMENTS

| | | | |
|---|---|---|---|
| EP | 0214939 | A3 | 3/1987 |
| EP | 0365491 | A2 | 4/1990 |
| EP | 0365491 | A3 | 4/1990 |
| WO | 2016/118614 | A1 | 7/2016 |

* cited by examiner

METHOD FOR MAKING A WADDING STRIP ELEMENT COMPRISING AT LEAST A SURFACE ADAPTED TO RECEIVE PRINT, AND THE WADDING STRIP ELEMENT MADE THEREBY, FOR US IN PADDINGS OF CLOTHING ARTICLES SUCH AS WINDCHEATERS AND SHOES

BACKGROUND OF INVENTION

The present invention relates, in an aspect thereof, to a method for making a wadding strip element including at least a surface adapted to receive print.

In a second aspect, the present invention also relates to the related to wadding strip element made by said method, in particular to be used for making paddings of clothing articles, such as, by way of non-limiting example, windcheaters and shoes.

As is known, wadding is a material with high porosity and low consistency.

A very common use of this wadding, generally made with a strip element configuration, is for paddings of clothing articles, among which, as stated, purely by way of non-limiting example, windcheaters and sneakers.

Due to its high porosity and low consistency, it was not previously possible to apply printed patterns to wadding strips, as the material deposited on the surface during printing would be dispersed between the fibers and no pattern or the like would actually be visible.

A method attempted to date for printing on wadding and/or for transferring desired materials onto at least a surface thereof was the dyeing method; however, known dyeing methods make the product susceptible to easily decomposing.

Methods have also been attempted to coat at least a desired surface of the wadding with films adapted to "stiffen" said wadding to allow it to receive the print and/or transfer material.

However, to date, these methods of applying films have not been successful commercially, so that a wadding that is "actually printable" is still not commercially available.

SUMMARY OF THE INVENTION

Therefore, in the light of the above drawbacks, hindering and/or preventing printing of known wadding strips, for the aforesaid uses, the main aim of the present invention is to provide a method that allows printed patterns to be applied to at least a surface of a wadding strip, wherein the printed patterns are long lasting, also following natural wear of the clothing article or frequent washes to which the clothing article is subjected.

Within the scope of the aforesaid aim, a main object of the present invention is to provide a method of the type indicated, which also allows the transfer to the wadding strip element of other materials, in addition to printing colors, adapted to improve the technical, in particular thermal, properties, i.e. providing an increase of insulation or heat dissipation to the wadding strip designed to form the base padding of a clothing article, these auxiliary materials being applied to improve, for example, the thermal insulation of the padding.

A further object of the present invention is to provide a method of the type indicated that can operate on any wadding strip for paddings of clothing articles is and/or the like, regardless of the fibers of which the wadding is made.

A further object of the present invention is to provide a method of the type indicated allowing the production of a new and inventive wadding strip adapted to receive print and, where desired, auxiliary materials to improve the technical properties of the paddings for clothing articles made from said wadding strip, and also allowing optimal and even dispersion or distribution of the heat produced in the clothing article including the wadding padding of the invention, as well as dissipation of any electrostatic charges.

A further object of the present invention is to provide a method of the type indicated that comprises a minimum number of extremely simple operating steps, all of which can be performed on devices and/or systems commercially available or easy to produce for the person skilled in the art.

A further object of the present invention is to provide a method of the type indicated that, while giving the wadding strip the desired properties of printability and transfer of any desired material, is so inexpensive that there is no substantial increase in cost for the printable wadding strip compared to commercially known wadding strips.

A further object of the present invention is to provide a method of the type indicated, providing a printable wadding strip that can be easily treated in existing devices for making paddings without complicating the usual steps for converting a generic wadding strip of a known type into the desired and greatly improved padding.

Another object of the present invention is to provide a method of the type indicated, that allows easy printing of a wadding strip made of any fiber mixture, in particular virgin fibers, recycled fibers, and/or microfibers, and of nanotube type materials.

According to an aspect of the present invention, the above mentioned aim and objects, as well as further objects which will become more apparent below, are achieved by a method for making a wadding material, in particular to be used for making paddings of clothing articles such as windcheaters and/or shoes, said wadding material being designed for depositing thereon at least an auxiliary material, said method comprising the steps of providing a wadding strip element having high porosity and low consistency, said wadding strip element having a first main surface, a second main surface and preset thickness, as well as a preset mechanical strength and porosity, said method being characterized in that it includes at least a further step of subjecting said wadding strip element to a combined chemical, mechanical and thermal treatment process adapted to increase said preset strength of said wadding strip element and reduce said preset porosity of said wadding strip element thereby allowing the deposit on at least a said first main surface of at least a said auxiliary material in such a manner that said deposited material only slightly penetrates the wadding material so as to create on said main surface a predetermined printed pattern configuration adapted to withstand washing operations and inevitable wear, without decomposing.

BRIEF DESCRIPTION OF THE DRAWINGS

Further characteristics and advantages of the method of the present invention and of the printable wadding strip element produced thereby will become more apparent below from the following detailed description of a preferred embodiment thereof, illustrated by way of indicative and non-limiting example in the accompanying schematic drawings, wherein.

DESCRIPTION OF THE PREFERRED EMBODIMENT

Figure 1:
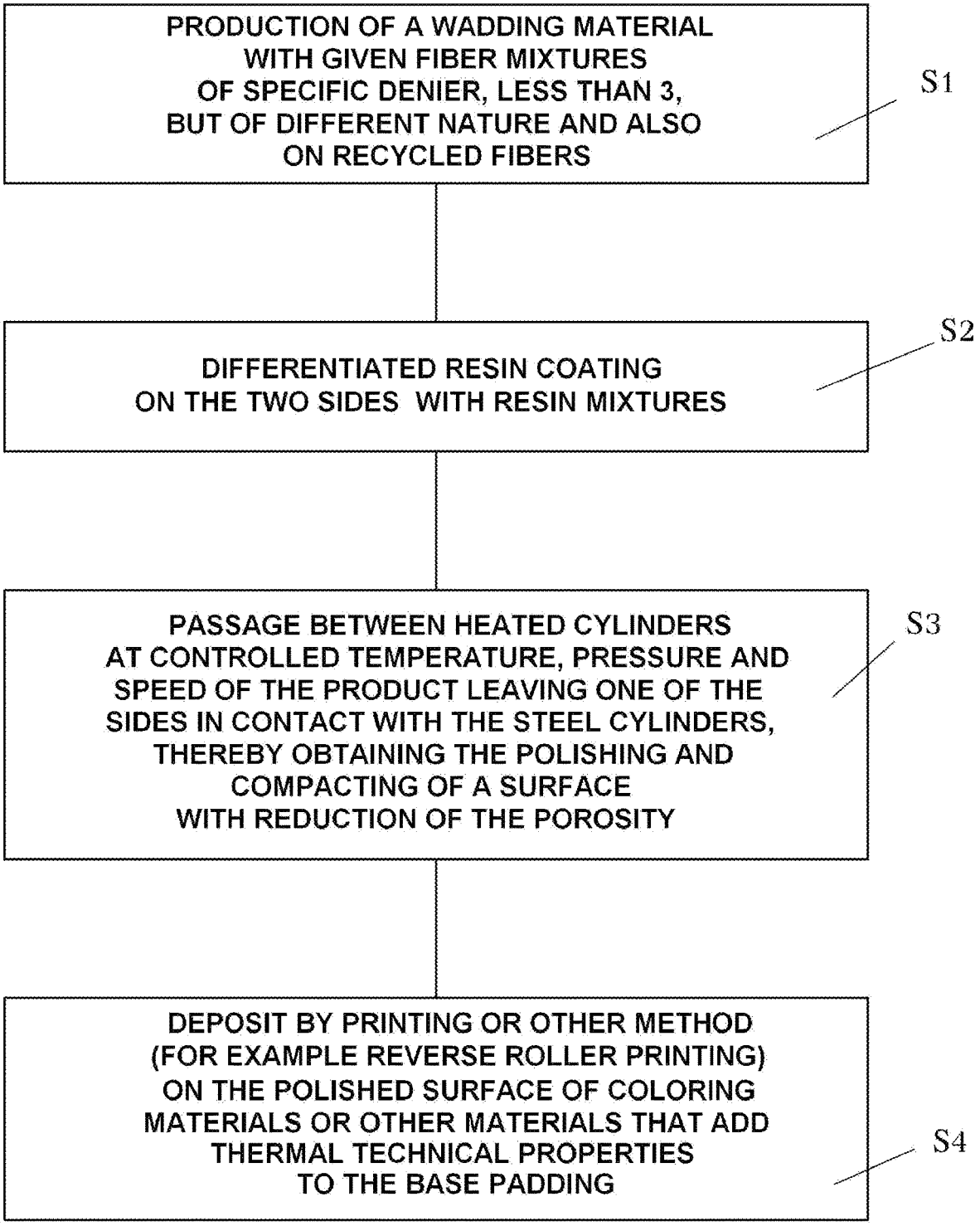
FIG. 1 is a flow chart illustrating the main steps of the method of the present invention.

With reference to the aforesaid drawings, FIG. 1 shows an example of a flow chart of the main steps of the method of the invention.

More specifically, in a first operating step S1, wadding is made, in particular but without limitation, in the form of a strip, with given fiber mixtures of specific denier, for example advantageously less than three, but of a different nature and also of recycled fibers.

In a subsequent operating step S2, the two main surfaces or sides of the wadding strip made in the step S1 are coated with resin in a differentiated manner with suitable resin mixtures that will be described in more detail below.

In a subsequent operating step S3, the strip with the two main resin coated surfaces is caused to pass between at least two heated cylinders having a controlled temperature, pressure and speed, leaving one of the sides of the strip, according to the invention, in contact with the cylinders, preferably made of steel, so as to obtain polishing of a main surface, for example the upper surface, of the strip and the compaction thereof, with a reduction of the wadding porosity.

Finally, in a further operating step S4 of the method of the invention, printing colors or other materials adapted to add technical thermal properties to the base padding are deposited on the polished main surface by printing or other method, for example preferably by the reverse roller method, or by means of embossed cylinders or printing plates or screens.

Figure 2:
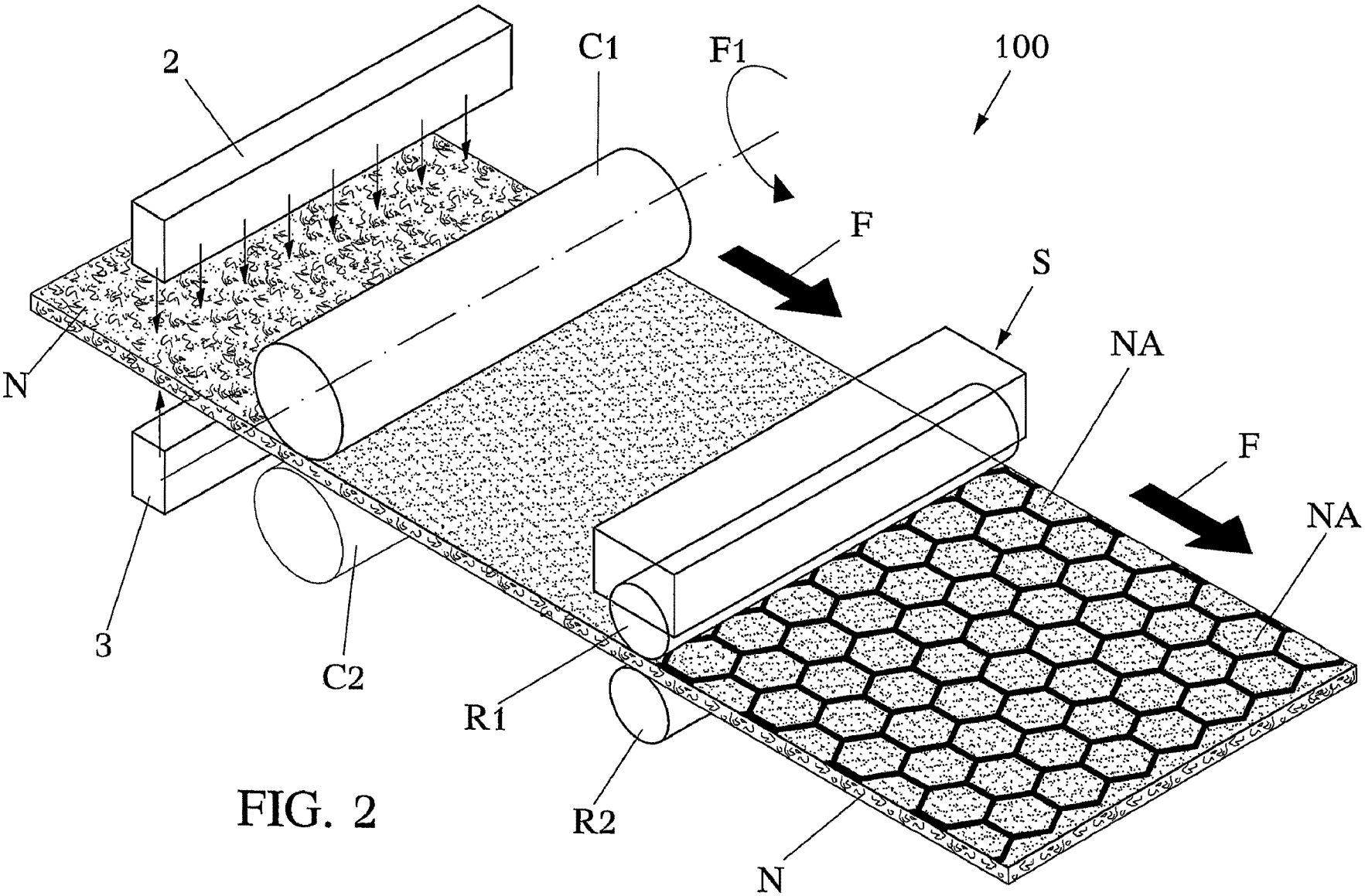
FIG. 2 is a schematic view of a possible configuration of a possible device, illustrated by way of indicative and non-limiting example, for implementing the method of the present invention, to allow printing and transfer of desired materials in general on a wadding strip.
Figure 3:
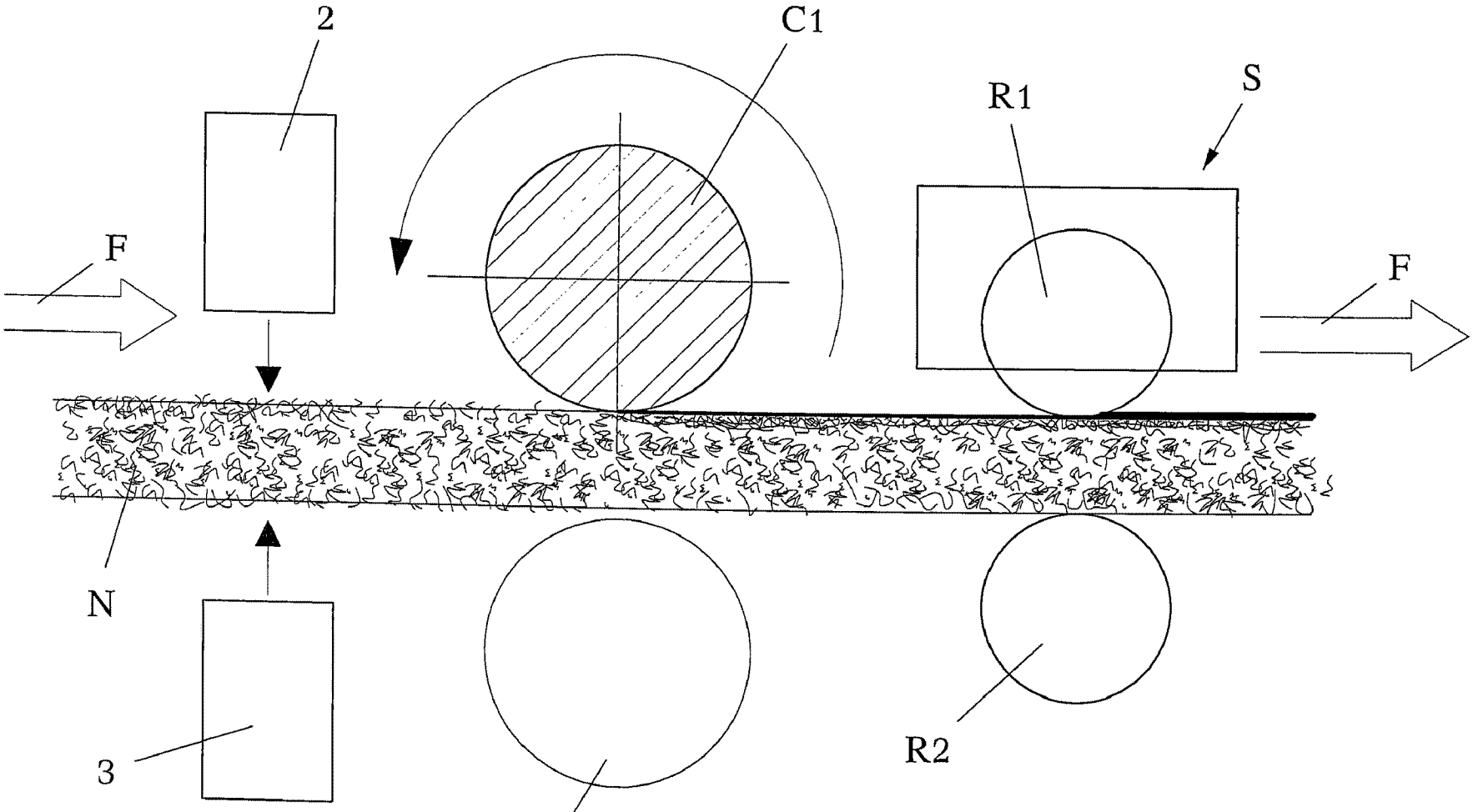
FIG. 3 is a more detailed schematic view useful to understand the operation of the device of FIG. 2 for implementing the method of the invention.
Figure 4:
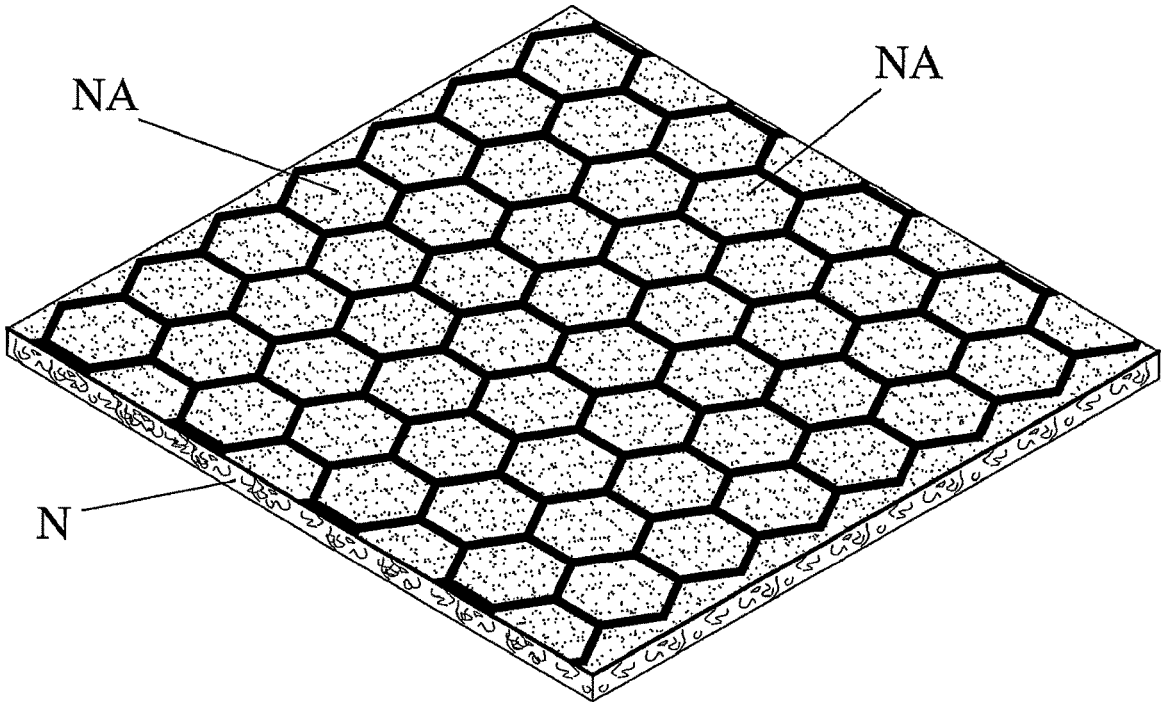
FIG. 4 shows a portion of a printed wadding strip, after having been made suitable to receive print and/or transfer of any desired material by means of the method of the invention.
Figure 5:
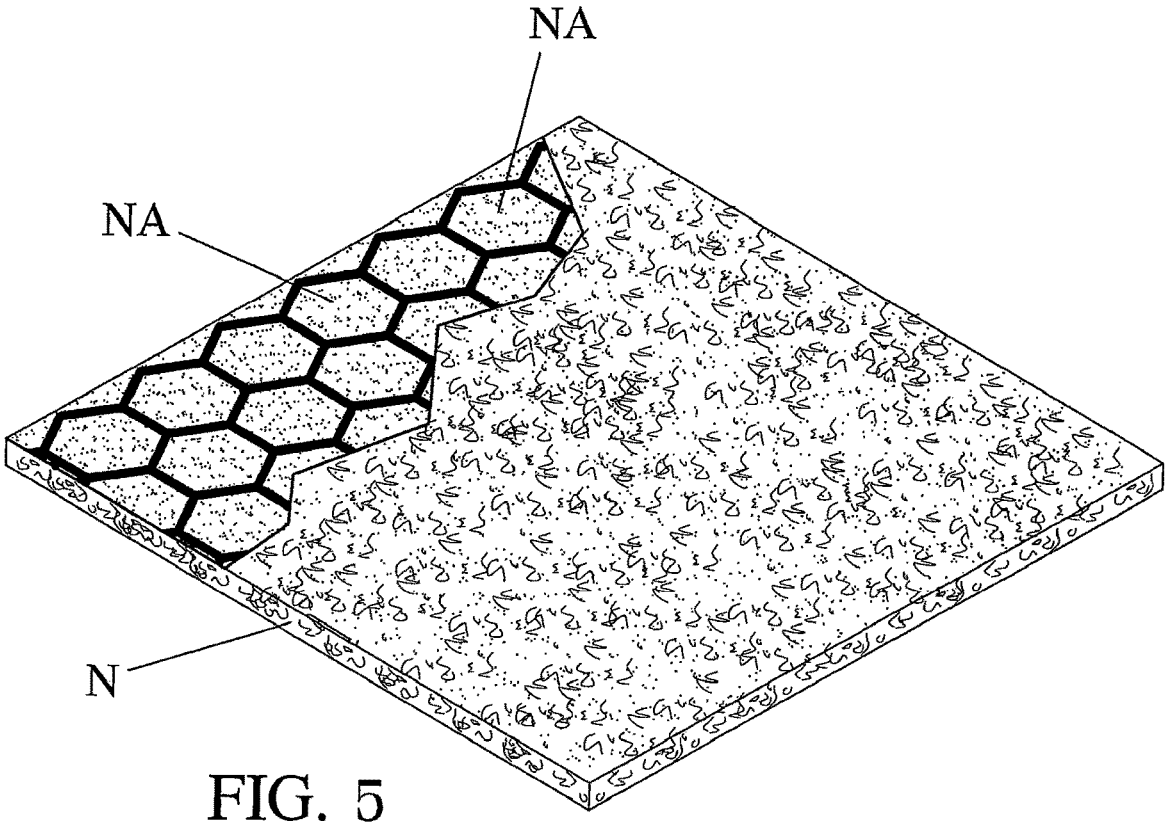
FIG. 5 is a further schematic view of a partial portion of the printed wadding strip of FIG. 4.

The preceding operating steps can be carried out, for example, by a device comprising as main members, those schematically shown in FIG. 2, and generally indicated by the reference numeral 100.

In particular, at the inlet (left-hand in FIG. 2) of the device 100, the wadding strip N, previously made from the desired fibers, as will be described in greater detail below, is caused to pass between two assemblies, one upper 2 and one lower 3 for the application to the upper main surface 1 and to the lower main surface 2, or sides of the wadding strip N, suitable resin materials, in a differentiated manner, by means of any desired method, for example spraying or coating.

Subsequently, the web thus treated at least on the upper 1 and lower 2 main surfaces is caused to move in the direction of the arrows F and to pass first between at least two cylinders, i.e. an upper cylinder C1 and a lower cylinder C2, preferably made of steel, of which the upper cylinder is advantageously heated to a preset temperature, as will be described in greater detail below.

Subsequently, the strip N, maintained pressed between the cylinders C1 and C2, suitably heated, will acquire reduced porosity and increased mechanical strength, as shown at the outlet of the cylinders C1 and C2 preferably rotating, for example, in the direction of the arrow F1, i.e. in FIG. 2, counter-clockwise.

Subsequently, in a final printing assembly S, the strip will be subjected to a desired printing operation, or an operation for transferring desired materials, for example by means of the well-known reverse roller R1 and R2 printing method, so that, at the outlet of the printing assembly and/or the assembly for transfer of desired materials, the strip can have the configuration in which, by way of example, a plurality of honeycomb elements NA, in contact with one another on substantially all their sides, are provided on the main upper surface of the strip.

Preferably, the honeycomb configuration NA will be obtained by applying, for example by means of the aforesaid reverse roller printing method, or any other suitable printing method, a graphene material having the well-known properties of heat and electrostatic charges dissipation, and further advantageous properties such as heat regulation, antibacterial, rapid drying properties and yet others.

From tests carried out by the Applicant it was found that the honeycomb structure printed on the upper main surface of the wadding strip treated with the method according to the invention showed electrical continuity such as to dissipate, for example, any electrostatic charge, and improved properties of dissipation of heat and air friction produced in a clothing article padded with the printed strip of the invention.

Therefore, as stated, the method of the present invention comprises the steps of: S1) making a wadding material from a preset fiber mixture of a preset denier, but of a different nature and also synthetic fibers; S2) coating the first and second main surfaces of the wadding strip element in a differentiated manner with preset resin mixtures; S3) causing the wadding strip element with differentiated resin coating to pass between heated cylinders at controlled temperature, pressure and speed of the wadding strip element, leaving the first main surface of the wadding strip element in contact with the cylinders, preferably made of steel, to obtain polishing of the main surface thereof and reduce its porosity; S4) depositing by printing or by another deposition method on the compacted and polished surface, coloring materials or other materials adapted to add thermal and decorative properties (if, for example, sheer nylon fabrics are used) to the wadding material of the wadding strip element.

In the method of the invention, the materials to be transferred are advantageously selected from one or more of the following materials: graphene, aluminum, titanium dioxide, aerogel, nano or non-nano elements and/or the like, although graphene is the preferred material.

Advantageously, the fiber mixture comprises a preset percentage of microfibers in a virgin and/or recycled fiber matrix.

According to a further aspect of the method of the invention, the fiber mixture comprises 100% recycled fibers.

In the method of the invention, the step of coating the first and second main surfaces of the wadding strip element with resin in a differentiated manner comprises applying to the first and second main surfaces at least two different resins, advantageously selected from vinyl resins, butadiene resins, styrene-vinyl resins and acrylic resins and any others known to those skilled in the art or that will be developed subsequently.

The Applicant has found that optimal results for printing and transferring of the desired materials are obtained with acrylic resins having respective Tg values variable from −40 to +40 and adapted to operate as carriers for said materials for attributing the desired thermal properties.

Advantageously, in the method of the invention, the Applicant has also found that optimal results were obtained by making said cylinders from steel, and preferably by heating them to a temperature ranging from 130° C. to 150° C. and contacting the first and second main surfaces of the wadding strip element for a period of time adapted to allow crosslinking of the resin and substantially of 5 minutes by means of passage through a drying oven.

Of course, in the practical implementation of the method of the invention, not only one assembly of cylinders C1 and C2, but for example several assemblies of these cylinders arranged in series may be used.

Tests carried out by the Applicant have also allowed to determine that, at the end of the method, the mechanical strength of the wadding strip increased by about 50%, while the porosity was reduced substantially by 100% with respect to an initial porosity.

Tests carried out by the Applicant have also allowed to determine that the CLO value was optimized, i.e., in the strip of the invention it was possible to obtain the same CLO value as that of a conventional padding strip, while using less fiber, with a great saving of costs, taking into account that to obtain 1 kg of fibers 2 kg of oil are generally used.

The CLO value measured allowed even heat distribution in a plurality of clothing articles made using as padding the padding obtained by means of the method of the invention.

Therefore, the method of the invention provides a wadding strip element for making paddings of clothing articles, wherein the wadding strip element has at least a surface adapted to receive printed patterns and an improved thermal insulation property adapted to give to the padding of clothing articles treated with the aforesaid materials, as stated, the same CLO value as that of a corresponding known padding, but using an amount of fibers less than that used in the corresponding known padding.

Therefore, the padding obtained by means of the wadding treated according to the method of the invention is particularly suitable to be used in the field of clothing articles, in particular of windcheaters or sneakers.

From the above it can be noted how the present invention fully achieves the intended aim and objects.

In fact, the method of the invention allows wadding to be made with a given fiber mixture of a specific denier, but of a different nature and also of recycled fibers.

Moreover, due to the method of the invention, it is possible to increase the performance of a conventional wadding strip, with the aforesaid materials transferred, for example to greatly increase the thermal insulation of the padding produced, and with the same CLO value, using less fiber.

Ultimately, it is possible to dissipate and evenly distribute heat in the desired clothing article.

The method of the invention is susceptible to numerous changes and variants, all falling within the scope of the concept of the invention.

Therefore, the method of the invention will be limited by the formulation of the appended claims, rather than by the above description.

The invention claimed is:

1. A method for making a wadding material, to be used for making paddings of clothing articles, said wadding material being adapted for depositing thereon at least an auxiliary material, said method comprising the steps of providing a wadding strip element having high porosity and low consistency, said wadding strip element having a first main surface, a second main surface and a preset thickness and preset mechanical strength and porosity, said method comprising at least a further step of subjecting said wadding strip element to a combined chemical, mechanical and thermal treatment process adapted to increase said preset strength of said wadding strip element and reduce said preset porosity of said wadding strip element thereby allowing deposition on said at least a first main surface of at least a said auxiliary material thereby said deposited material penetrates the wadding material to create on said main surface a printed pattern configuration adapted to withstand washing operations and inevitable wear, without decomposing, the method comprising the steps of;

S1) making said wadding strip element from a synthetic fiber mixture of a preset denier;

S2) coating said first and second main surfaces of said wadding strip element with resin mixtures;

S3) causing said wadding strip element with said resin mixtures on said main surfaces to pass between heated cylinders at a controlled temperature, pressure and speed of said wadding strip element, leaving said first main surface of said wadding strip element in contact with said cylinders to obtain polishing of said surface and reduce its porosity and to obtain a compacted and polished surface;

S4) printing on said compacted and polished surface graphene material to create on said compacted and polished surface said printed pattern configuration formed by said graphene material.

2. A method, according to claim 1, wherein said fiber mixture comprising a preset percentage of microfibers in a virgin and/or recycled fiber matrix.

3. A method, according to claim 1, wherein said fiber mixture comprising 100% recycled fibers.

4. A method, according to claim 1, wherein said step of coating said first and second main surfaces of said wadding strip element with said resin mixtures comprising applying to said first and second main surfaces at least two different resins selected from a group comprising vinyl resins, butadiene resins, styrene-vinyl resins and acrylic resins, said resins preferably having Tg values variable from −40 to +40 and all being adapted to operate as carriers for said transferred materials.

5. A method, according to claim 1, wherein said cylinders being steel cylinders which are heated to a temperature from 130° C. to 150° C. and contacting said first and second main surfaces of said wadding strip element for a period of time adapted to allow crosslinking of said resin mixtures, said period of time corresponding substantially to 5 minutes of passage through a heated oven.

6. A method, according to claim 1, wherein at the end of said method, said wadding strip treated by said method having a mechanical strength increased by about 50% and a porosity reduced by substantially 100% with respect to an initial porosity of said wadding strip element.

7. A wadding strip element for making paddings of clothing articles, obtained by means of a method according to claim 1, said wadding strip element comprising said compacted and polished surface, and said wadding strip element comprising said printed pattern configuration adapted to add thermal properties to the wadding material arranged on said compacted and polished surface.

8. A clothing article comprising a padding element including the wadding strip element according to claim 7.

9. A method, according to claim 1, where said printed pattern configuration further provides a decorative property of a plurality of honeycomb elements having sides which are in contact with one another on substantially all of said sides.

* * * * *